United States Patent [19]

Makino et al.

[11] 3,961,946

[45] June 8, 1976

[54] MAGNETIC ALLOY FOR USE IN THERMO AND MAGNETO PRINTING

[75] Inventors: Yoshimi Makino, Fujisawa; Shigeyasu Ito, Yokohama, both of Japan

[73] Assignee: Sony Corporation, Tokyo, Japan

[22] Filed: Feb. 6, 1975

[21] Appl. No.: 547,542

[30] Foreign Application Priority Data

Feb. 13, 1974 Japan ..... 49-17458

[52] U.S. Cl. ..... 75/172 R; 75/170; 148/31.55

[51] Int. Cl.[2] ..... C22C 5/04

[58] Field of Search ..... 75/172 R, 170; 148/31.55, 31.57

[56] References Cited

UNITED STATES PATENTS

| | | | |
|---|---|---|---|
| 3,206,337 | 9/1965 | Walmer | 75/172 R X |
| 3,689,254 | 9/1972 | Inoue et al. | 75/172 R |
| 3,860,458 | 1/1975 | Inoue et al. | 148/31.55 X |

*Primary Examiner*—L. Dewayne Rutledge
*Assistant Examiner*—E. L. Weise
*Attorney, Agent, or Firm*—Hill, Gross, Simpson, Van Santen, Steadman, Chiara & Simpson

[57] ABSTRACT

Magnetic alloy containing platinum, cobalt and nickel is disclosed which is suitable for use with magnetic recording medium, especially for use with an intermediate magnetic recording medium in thermo and magneto printing.

1 Claim, 2 Drawing Figures

MAGNETIC ALLOY FOR USE IN THERMO AND MAGNETO PRINTING

BACKGROUND OF THE INVENTION

1. Field of the Invention

This invention relates generally to magnetic alloy, and more particularly to magnetic alloy for use with a magnetic recording medium in thermo and magneto printing.

2. Description of the Prior Art

There are various methods for printing (or copying) recorded informations from one magnetic recording medium such as a magnetic tape to another magnetic recording medium, possibly also a magnetic tape.

One of these methods is proposed in the U.S. Pat. No. 3,496,304, and the method is as follows.

1. Preparing a master magnetic recording medium (simply saying a master carrier) being recorded with a original signal thereon, an intermediate recording medium (simply an intermediate carrier) and a copy magnetic recording medium (simply a copy carrier) on which the original signal should be copied.
2. Heating the intermediate carrier above its Curie temperature.
3. Placing said heated intermediate carrier in contact with the master carrier during cooling from the heated temperature to a temperature below the Curie temperature of the intermediate carrier. This is thermo printing process.
4. Separating the master carrier from the intermediate carrier.
5. Placing the intermediate carrier in contact with the copy carrier and applying A.C. bias magnetic field. (This is magneto printing process.)
6. Separating the intermediate carrier and the copy carrier each other. The original signal recorded on the master carrier is printed on the intermediate carrier in the thermo printing process. The printed signal on the intermediate carrier is then printed on the copy carrier in the magneto printing process. Finally, the original signal recorded on the master carrier is printed on the copy carrier. In this method, by using an intermediate carrier, an original signal and a printed signal are the same each other in the direction of magnetization. So it is no need to prepare a particular master carrier which is recorded with a mirror image of the original signal, and every normally recorded magnetic recording medium can be used as a master carrier. But in this method, the intermediate carrier has to satisfy hard characteristics in magnetic property, mechanical property, physical and chemical stability, durebility and so on.

In the U.S. Pat. No. 3,496,304, Chromium Dioxide (CrO2) tape is used, because CrO2 has a lower Curie temperature (Tc = 120°C). but CrO2 does not satisfy the required characteristics, especially coercive force and residual magnetic flux density.

Another material suitable for use with an intermediate carrier is iron-cobalt-phosphorus sputtered coating on a non magnetizable support. For example, sputtered coating of $(Fe_{0.85}Co_{0.15})P_{0.5}$ has magnetic characteristics superior than that of CrO2 and proper Curie temperature. But iron-cobalt-phosphorus is not so stable chemically, by heating the same it is assumed that phosphorus atom evaporates from the sputtered coating, and iron-cobalt is oxidized rather easily. Further, manufacturing of such sputtered coating of uniform composition is difficult and has to employ complicated apparatus.

SUMMARY OF THE INVENTION

It is an object of this invention to provide a novel magnetic alloy suitable for use with a magnetic recording medium.

It is another object of the invention to provide a novel magnetic alloy suitable for use with an intermediate magnetic recording medium in thermo and magneto printing.

It is further object of the invention to provide a novel magnetic alloy having a suitable Curie temperature and good magnetic characteristics suitable for use with an intermediate magnetic recording medium in thermo and magneto printing.

The other objects, features and advantages of this invention will be apparent from the following description taken in conjunction with the accompanying drawings.

DESCRIPTION OF THE PREFERRED EMBODIMENTS

Figure 1:
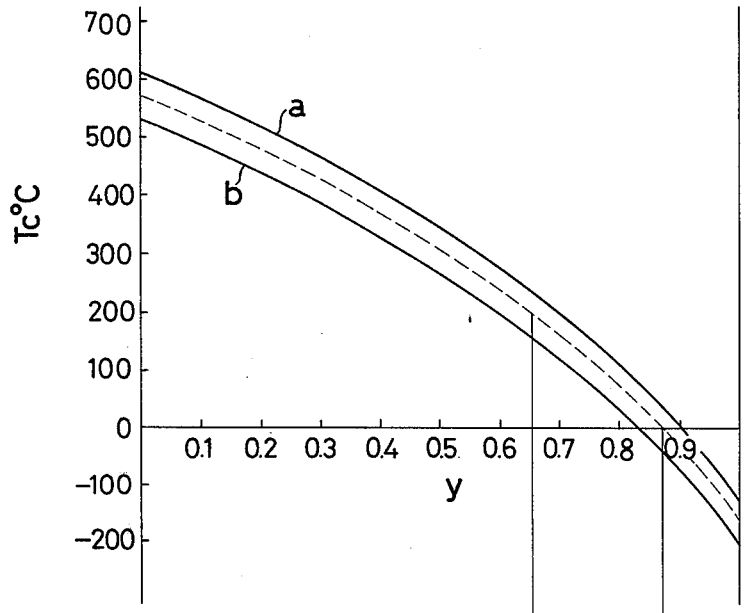
FIG. 1 is a graph showing the relation between Curie temperature (Tc) and composition rate of platinum-cobalt-nickel alloy $Pt_{0.5}(Ni_yCo_{1-y})0.5$.

In the above mentioned method of printing recorded signal from one magnetic recording medium on another magnetic recording medium, the intermediate carrier is used both in thermo printing and magneto printing processes. So the intermediate carrier is required to satisfy hard characteristics in magnetic property, mechanical property, physical and chemical stability, durability and so on.

The required characteristics for the intermediate carrier is as follows.

1. In thermo printing process.

a. Curie Temperature (Tc).

Various kinds of magnetic recording medium can be used as an master carrier, for example, alloy sheet of Cunife alloy (cupper-nickel-iron alloy), Vicalloy (cobalt-vanadium-iron alloy), an electro deposited tape or practically used magnetic tape which is coated with ferromagnetic particles on a non magnetizable support. The Curie temperature of chromium dioxide (CrO2) is the lowest in the practically used magnetic recording medium, which is 120°C.

printing process is carried out by cooling the master carrier and the intermediate carrier from temperature higher than the Curie temperature of the intermediate carrier, so it is required that a recorded signal on the master carrier isn't missed or deteriorated by the thermal treatment and isn't distorted by the difference of thermoexpansion between the master carrier and the intermediate carrier. From the above requirements the Curie temperature of the intermediate carrier should be not higher than 200°C.

Temperature difference between the temperature at which the thermo printing is carried out and the temperature at which the magneto printing is carried out should be more than 80°C. considering the requirements of high coercive force and high residual magnetic flux density at the temperature where the magneto printing is carried out.

Further, considering a practical method of heating and cooling, the Curie temperature of the intermediate carrier should be not lower than 0°C. So Curie temperature range is expressed as follows.

$$0°C \leq Tc \leq 200°C$$

b. Temperature dependency of Br/Hc (ratio of residual magnetic flux density (Br) and coercive force (Hc)).

To avoid so-called self-demagnetization, the ratio Br/Hc should be not more than 5 at every temperature in thermo printing process.

c. Temperature dependency of rectangular ratio (Rs)

$$Rs = \frac{Br \text{ (residual magnetic flux density)}}{Bs \text{ (saturation magnetic flux density)}}$$

Rs should be as large as possible, and more than 0.8 is desirable.

Further, it is preffered that Rs doesn't depend on the direction.

d. Thermal conductivity.

To avoid unevenness of temperature, and to respond to the change of temperature, high thermal conductivity is desirable.

f. Stability.

The intermediate carrier has to be stable physically, chemically and mechanically in air in thermal treatment. (i.e. stability of composition rate, resistance to oxidation and so on)

2. In magneto printing process.

a. Coercive force (Hc).

It is well known that the magnitude of A.C. bias magnetic field should be at least twice of the coercive force of the copy carrier. To avoid the recorded signal on the intermediate carrier being disturbed by the A.C. bias magnetic field, the coercive force of the intermediate carrier should be more than three times of that of the copy carrier. The copy carrier used practically now, has it's coercive force 250~600 Oe. Then, the coercive force of the intermediate carrier should be more than 1,800 Oe.

b. Residual magnetic flux density (Br).

Br should be more than 2000 gauss, further more than 3,000 gauss is highly desirable.

c. Temperature at which the magneto printing is carried out should be at least 80°C. lower than the temperature at which the thermo printing is carried out, to obtain the above mentioned high coercive force and high residual magnetic flux density.

Further, considering a practical method of cooling the temperature should be near the room temperature or temperature easily realized by the practical cooling method.

So this invention provides a novel magnetic alloy satisfying the above mentioned characteristics and suitable for use with an intermediate carrier.

It is well known that platinum-cobalt (Pt - CO)intermetallic compound is a permanent magnet of super lattice type, having high coercive force by the proper thermal treatment. The Pt - Co magnet has static magnetic characteristics at the room temperature as follows.

$$Hc = 6{,}500 \text{ Oe.}$$

$$Bs = 7{,}500 \text{ gauss}$$

$$Tc = 570°C$$

It's also stable physically, chemically and mechanically in air and has good rolling property as compared with the other permanent magnets.

So if it's able to let down the Curie temperature of platinum-cobalt alloy, it is suitable for use with the intermediate carrier.

It is rather easy to let down the Curie temperature of platinum-cobalt alloy by adding other chemical elements but in this case magnetic characteristics are also deteriorated because, by adding these elements, the orderliness of platinum-cobalt atoms is disturbed.

We succeeded to let down the Curie temperature without deterioration of the magnetic characteristics, by providing a solid solution of platinum-cobalt magnetic alloy with platinum nickel (Pt - Ni) alloy. Platinum-nickel alloy is a super lattice type alloy same as platinum-cobalt alloy. The Curie temperature of the platinum-nickel is −200°C. The Curie temperature of the obtained platinum-nickel-cobalt alloy is easily controlled by the composition rate. In this specification, we represent generally this platinum-nickel-cobalt alloy as $Pt_x(Ni_yCo_{1-y})_{1-x}$.

FIG. 1 shows the Curie temperature (Tc) of the alloy $Pt_{0.5}(Ni_yCo_{1-y})_{0.5}$. In FIG. 1, a solid line *a* indicates the Curie temperature in disordered lattice state, solid line *b* in ordered lattice state. The Curie temperature in the state having maximum coercive force, which is achieved by proper thermal treatment, is indicated by a dotted line which exists between the lines *a* and *b*.

Referring to FIG. 1, an effective composition rate of the platinum-nickel-cobalt alloy which satisfies the required Curie temperature range, ie $0°C \leq Tc \leq 200°C$, should be as follows.

$$X = 0.5$$

$$0.65 \leq y \leq 0.86$$

Further, a composition rate to obtain ordered alloy easily is not limited to x value equal to 0.5 only. We confirmed experimentally that when x value is not less than 0.45 and not more than 0.55, the ordered alloy is easily obtained by proper final annealing. In our experiment, obtained coercive force of platinum-nickel-cobalt alloy of $Pt_{0.45}(Ni_{0.75}Co_{0.25})_{0.55}$ and $Pt_{0.55}(Ni_{0.75}Co_{0.25})_{0.45}$ were 2,100 Oe and 1800 Oe, respectively. The Curie temperature were both 130°C. But the coercive forces of $Pt_{60}(Ni_{75}Co_{25})_{40}$ and $Pt_{40}(Ni_{75}CO_{25})_{60}$ were 200 Oe and 600 Oe, respectively.

Still, alloy of the above mentioned composition is improved in its rolling property by adding small amount of manganese Mn, vanadium V, chromium Cr, tungsten W or germanium Ge.

Figure 2:
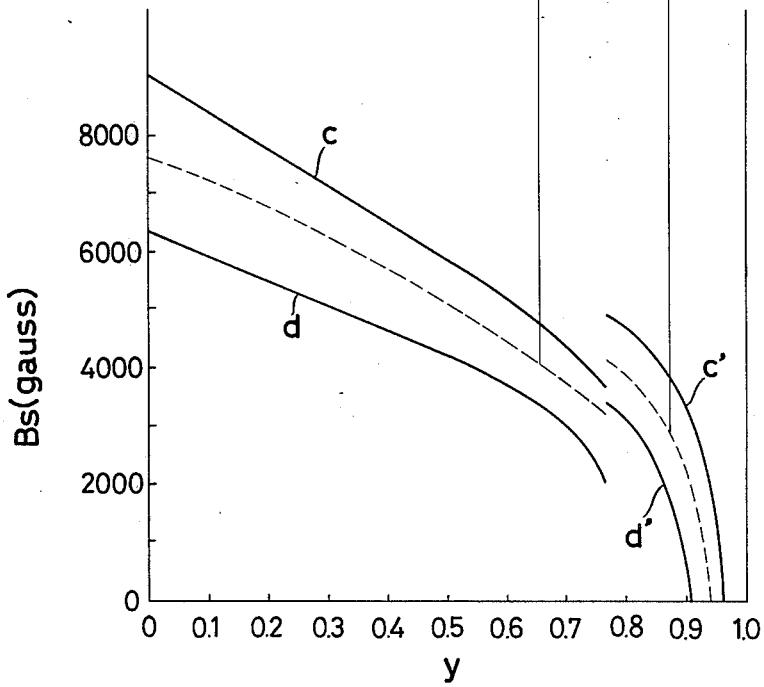
FIG. 2 is a graph showing the relation between saturation magnetic flux density (Bs) and composition rate of platinum-cobalt-nickel alloy $Pt_{0.5}(Ni_yco_{1-y})0.5$.

FIG. 2 shows the saturation magnetic flux density (Bs) of the alloy $Pt_{0.5}(Ni_yCO_{1-y})_{0.5}$.

In FIG. 2, solid lines *c* and *c'* indicate Bs in disordered lattice state, while lines *d* and *d'* indicate Bs in ordered lattice state. About the alloy having the Curie temperature not lower than 100°C, Bs is measured at the room temperature while about the alloy having the Curie temperature lower than 100°C, Bs is measured at −80°C. Bs in the state having the maximum coercive force is indicated by the dotted line which exists between the lines *c* and *d* or *c'* and *d'* .

The invention is now further illustrated with reference to the following specific examples.

EXAMPLE I

In this example, alloy of $Pt_{0.5}(Ni_{0.75}Co_{0.25})_{0.5}$ is obtained. The method of making an intermediate carrier made of $Pt_{0.5}(Ni_{0.75}Co_{0.25})_{0.5}$ is as follows.

Properly weighted Pt, Ni, and Co to satisfy the above mentioned composition rate were melted in an atmosphere of algon Ar gas by high frequency heating. Then, an 8 mili-meters thickness of alloy sheet was forged by pouring it into a predetermined cast. After this sheet was cold pressed to a thickness of 3 mili-meters. The sheet was maintained at 1,050°C for 2 hours, and then quenched. Next, it is pressed to the thickness of about 0.1 mili-meters. The sheet was annealed at 600°C for 1 hour. By the final annealing, the arrangement of its atoms was ordered and provides the maximum coercive force. Magnetic characteristics of thus obtained intermediate carrier was as follows.

Tc = 110°C
Br = 2600 gauss (at the room temperature)
Hc = 2900 Oe (at the room temperature)
Rs = 83% (at the room temperature)

Rs didn't depend on the direction. It is apparent that these characteristics satisfy every requirement in magnetic characteristics.

And, obtained alloy was stable physically, chemically and mechanically in the temperature range from the room temperature to 130°C.

Further, it was superior in thermal conductivity. Besides, in the manufacturing of the alloy, adding a small amount of Mn, improved rolling property.

Next, employing this intermediate carrier, printing process was carried out. First, a predetermined video signal was recorded on a master carrier which was coated with ferromagnetic alloy particles on a non magnetizable support by using a practical magnetic recording head. The magnetizable surface of the master carrier was placed in contact with the magnetizable surface of the intermediate carrier which was preliminarily heated at 130°C, cooled to the room temperature in air and separated each other. Then, the recorded surface of the intermediate carrier was placed in contact with a magnetizable surface of copy carrier which is coated with CrO2 particles on a non magnetizable support. A.C. bias magnetic field of 1,300 – 1,500 Oe and frequency of 50Hz was applied to the area of the contact. After gradually decreasing bias magnetic field, the intermediate carrier and copy carrier were separated each other.

Reproduced video signals from the copy carrier reproduced the signals recorded on the master carrier with high fedelity and obtained picture based therefrom was very fine. Large number of copies were printed from the same intermediate carrier, but this didn't cause deterioration of the signal recorded on the intermediate carrier.

EXAMPLE II

In this example, alloy of $Pt_{0.5}(Ni_{2/3}Co_{1/3})_{0.5}$ was obtained. An intermediate carrier was manufactured by the similar process of Example I. Obtained characteristics was as follows Tc = 190°C
Br = 3200 gauss (at the room temperature)
Hc = 4400 Oe (at the room temperature)
Rs = 84% (at the room temperature)

Rs didn't depend on the direction.

It is apparent that these characteristics satisfy every requirement.

Employing this intermediate carrier printing process was carried out similar to Example I. In this example, because of a rather high Curie temperature of the intermediate carrier, Cunife alloy (cupper-nickel-iron alloy) was employed as a master carrier.

The intermediate carrier was preliminarily heated at 210°C, then cooled to the room temperature, and the copy carrier was CrO2 tape.

Digital signal was recorded on the master carrier and copied on the CrO2 copy tape. Reproduced signal from the copy carrier was truly same as the signal of the master carrier.

As may be apparent from the above description, according to this invention, there is obtained novel magnetic alloy which is superior in magnetic characteristics of Hc, Br, Bs, Rs, in stability and having proper Curie temperature, so this invention is effective for an intermediate carrier in thermo and magneto printing.

We claim as our invention

1. Magnetic alloy for use in thermo and magneto printing, containing platinum, nickel and cobalt, as represented $Pt_x(Ni_yCo_{1-y})_{1-x}$ where x being not less than 0.45 and not more than 0.55, y being not less than 0.65 and not more than 0.86.

* * * * *